US008298101B2

(12) United States Patent
Babolat

(10) Patent No.: US 8,298,101 B2
(45) Date of Patent: Oct. 30, 2012

(54) RACKET HANDLE INSERT AND CORRESPONDING HANDLE AND RACKET

(75) Inventor: Eric Babolat, Lyons (FR)

(73) Assignee: Babolat VS, Lyons (FR)

( * ) Notice: Subject to any disclaimer, the term of this patent is extended or adjusted under 35 U.S.C. 154(b) by 249 days.

(21) Appl. No.: 12/312,639

(22) PCT Filed: Nov. 23, 2007

(86) PCT No.: PCT/FR2007/001929

§ 371 (c)(1),
(2), (4) Date: Nov. 10, 2009

(87) PCT Pub. No.: WO2008/078014

PCT Pub. Date: Jul. 3, 2008

(65) Prior Publication Data

US 2010/0056308 A1 Mar. 4, 2010

(30) Foreign Application Priority Data

Nov. 23, 2006 (FR) ..... 06 10263

(51) Int. Cl.
*A63B 49/08* (2006.01)

(52) U.S. Cl. ..... 473/551; 473/549

(58) Field of Classification Search ..... 473/549, 473/551

See application file for complete search history.

(56) References Cited

U.S. PATENT DOCUMENTS

| | | | | |
|---|---|---|---|---|
| 259,448 | A * | 6/1882 | Woodhouse | 473/551 |
| 1,133,622 | A * | 3/1915 | Darling | 473/549 |
| 2,576,751 | A * | 11/1951 | Dortmund | 81/489 |
| 4,696,842 | A | 9/1987 | Doubt | |
| 4,878,667 | A | 11/1989 | Tosti | |
| 5,263,275 | A * | 11/1993 | Rumbaugh | 43/23 |
| 5,482,270 | A | 1/1996 | Smith | |
| 5,492,324 | A | 2/1996 | Hagey | |
| 5,671,926 | A * | 9/1997 | Hagey | 473/549 |
| 6,146,038 | A * | 11/2000 | Mittersinker et al. | 401/6 |
| 6,213,902 | B1 | 4/2001 | Hagey | |
| 7,086,195 | B2 * | 8/2006 | Borgeat | 43/18.1 CT |
| 7,089,699 | B2 * | 8/2006 | Borgeat | 43/18.1 CT |
| 2005/0137037 | A1 | 6/2005 | Tucker | |
| 2006/0135295 | A1 * | 6/2006 | Szelenyi | 473/519 |
| 2007/0191155 | A1 * | 8/2007 | Babolat | 473/538 |
| 2010/0056308 | A1 * | 3/2010 | Babolat | 473/551 |

FOREIGN PATENT DOCUMENTS

WO WO 2004/033053 4/2004

* cited by examiner

*Primary Examiner* — Raleigh W. Chiu
(74) *Attorney, Agent, or Firm* — Dowell & Dowell, PC

(57) ABSTRACT

The invention relates to a racket handle insert which is intended to be placed around at least part of the core (2) of the handle and which, once in position, forms a first bulbous configuration (40, 50) having a central bulge (R, R'), the transverse dimensions of each bulbous configuration diminishing continuously from the bulge towards the two axial ends thereof.

29 Claims, 3 Drawing Sheets

RACKET HANDLE INSERT AND CORRESPONDING HANDLE AND RACKET

The present invention relates to an insert for a racket handle, a racket handle equipped with such an insert, and a racket equipped with such a handle.

The handle the invention aims for is capable of being used in any type of racket sport, especially tennis, badminton or squash.

Conventionally, a racket handle comprises a core, formed especially of a composite material possibly covered for example with foam, or of wood, at the outer periphery of which a covering strip, also called a grip, is wound. The racket comprises, apart from the aforementioned handle, a frame which defines either a strung head in the case of badminton, tennis or squash, or a full striking surface.

A racket handle usually has a cross section, for example polygonal and especially octagonal, the transverse dimensions of which are constant along this handle. This therefore involves a disadvantage in so far as this handle is not ergonomic, given that it does not correspond to the curvature of the palm of the hand.

Various solutions intended to improve the ergonomic character of this handle have therefore been proposed.

Thus, EP-B-0 291 576 describes a racket handle which has, in the hand region, a rounded edge-free cross section that has a bulge of greater transverse size. At its two ends, this edge-free area transforms into touch areas of polygonal cross section.

The solution described in this European patent has, however, certain drawbacks. Specifically, the manufacture of the handle described there turns out to be relatively complex. Furthermore, this solution is not modular, given that it is necessary for the user to buy a specific racket.

This having been specified, the invention aims to give any type of racket an ergonomic character quickly and conveniently. It aims in particular to provide this ergonomic character to commercial rackets already in the possession of users.

To this end, its subject is an insert as claimed in claim 1 below.

The invention will be described hereafter with reference to the appended drawings, provided only by way of nonlimiting example, in which.

Figure 1:
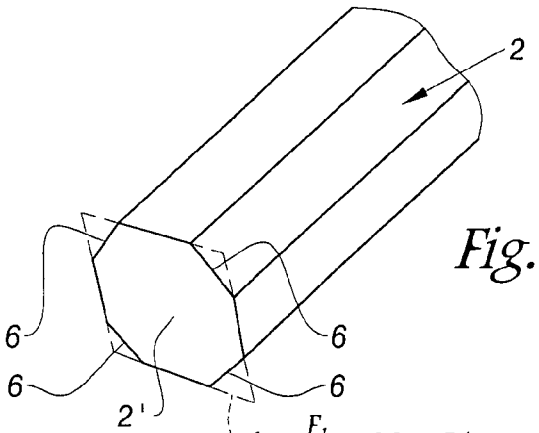
FIG. 1 is a perspective view of the core of a racket handle capable of receiving an insert according to the invention.

FIG. 1 illustrates a core 2 belonging to a racket handle which the invention proposes to deal with. In a manner known per se, this core 2 is made especially of a composite material possibly covered for example with foam, or of wood. It has an octagonal cross section, corresponding to a rectangle 4 shown in dotted lines which is truncated by four chamfers 6, especially oriented at 45°.

This core 2 is furthermore provided, usually, with various mechanical members (not shown), such as a cap provided at its free end 2', while its opposite end is attached, for example, to a strung head in the case of a tennis racket. Finally, the periphery of this core is designed to be covered with a covering strip or grip which is also not shown in this FIG. 1.

Figure 2:
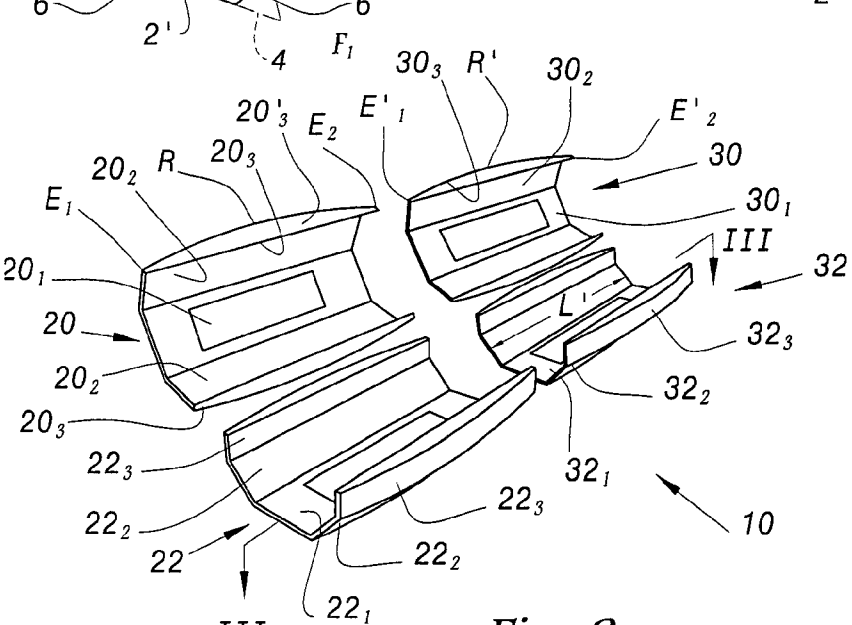
FIG. 2 is a perspective view illustrating an insert according to the invention.

FIG. 2 illustrates an insert according to the invention, denoted as a whole by the reference 10, which is capable of being fitted around the core 2 described above.

This insert 10 comprises four separate shells 20, 22, 30, 32 which are suited to cooperate in pairs. The first pair of shells 20 and 22 will first be described in greater detail.

These two first shells 20 and 22, which are identical, are made of a relatively rigid material, such as a composite carbon-based material for example, or a moldable thermoplastic, in particular polyamide. Each shell 20, 22 comprises a main middle partition $\mathbf{20}_1$, $\mathbf{22}_1$ from which two intermediate flaps $\mathbf{20}_2$, $\mathbf{22}_2$ extend at an angle approximately equal to 45°. Finally, each shell is terminated by two folding end sections $\mathbf{20}_3$, $\mathbf{22}_3$ extending at approximately 45° relative to a corresponding flap.

Figure 3:
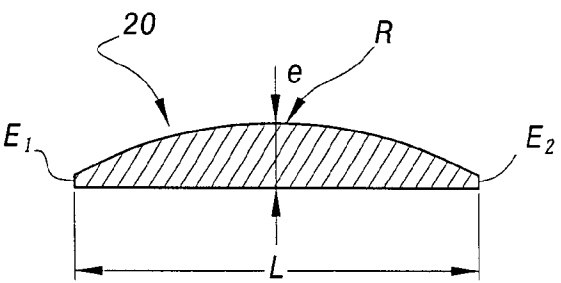
FIG. 3 is a longitudinal sectional view along the line III-III as in FIG. 2.

FIG. 3 is a longitudinal section of one the shells 20 or 22 which also corresponds to the profile of one of the free edges of the flaps, for example that with the reference number $\mathbf{20'}_3$ in FIG. 2. In this respect, it should be underlined that this longitudinal profile is overall identical at each point of the shells, whether at the partition, flaps or folding sections.

In this FIG. 3, $E_1$ and $E_2$ denote the axial ends of the shell considered, which in this case is that with the reference number 20. A middle bulge R is furthermore provided, the profile of this shell being, for example, symmetric relative to a middle vertical axis.

The length L of the shell is between 50 and 130 mm, preferably between 60 and 120 mm, while its maximum thickness e, which corresponds to that of the bulge R is, for example, between 1 and 7 mm, preferably between 1.5 and 6 mm. In this respect, it will be noted that close to the two ends $E_1$ and $E_2$ the shell has a very low thickness, in any case clearly less than that e of the bulge R.

This thickness of the shell decreases continuously from the middle bulge R towards the two axial ends $E_1$ and $E_2$. This means that a region of the shell for which this thickness is approximately constant may exist.

The shells 20 and 22 described above are designed to form a bulb shape for the player's main grip, namely the one-handed forehand or the backhand, as will be seen more precisely in the following. The two other shells 30 and 32 are, for their part, designed to form a second bulb shape for the positioning of the second hand, for example for the two-handed backhand.

In these conditions, these shells 30 and 32 have a structure similar to that of shells 20 and 22. Thus a partition $\mathbf{30}_1$, $\mathbf{32}_1$, flaps $\mathbf{30}_2$, $\mathbf{32}_2$, along with folding sections $\mathbf{30}_3$, $\mathbf{32}_3$ are again found. These shells 30 and 32 may be made of the same material, or of a material equivalent to that constituting the first shells 20 and 22. By way of a variant, they may be formed of a material having different properties from those of the shells 20 and 22, especially in terms of hardness. Finally, the longitudinal section of these shells 30 and 32 is similar to those of the shells 20 and 22, with the presence of a middle bulge R', which is visible in FIG. 2.

However, given that these shells 30 and 32 are designed to form a reverse side bulb shape, they optionally have dimensions less than those of the shells 20 and 22. Thus, their length L' is, for example, between 50 and 120 mm, preferably between 60 and 100 mm, while their maximum thickness e' is, for example, between 1 and 7 mm, preferably between 1.5 and 6 mm.

Figure 4:
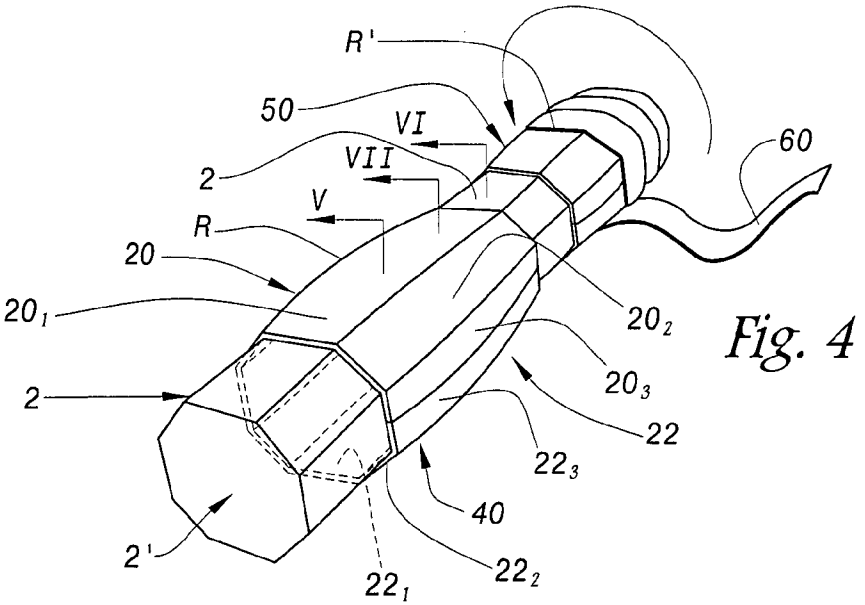
FIG. 4 is a perspective view illustrating the handle of FIG. 1 around which the insert of FIG. 2 is fitted.

FIG. 4 illustrates the fitting of the various shells 20, 22, 30 and 32 around the core 2 of the racket handle.

The two first shells 20 and 22, for the main grip, are fitted to the periphery of the core 2, close to the free end 2' while being distant from it. So as to ensure a better joining of the shells, it is possible to use an adhesive of any suitable type. To this end, the shell may be provided with an adhesive face protected by a film which is removed before the operation of application. It is also possible to apply an adhesive layer, such as glue, before fitting each shell.

Once fitted around the core, these two shells 20 and 22 form a first bulb shape 40 of octagonal cross section. Thus the two partitions $\mathbf{20}_1$ and $\mathbf{22}_1$ form two opposite sides of this octagon, while the flaps $\mathbf{20}_2$ and $\mathbf{22}_2$ form four additional sides. Finally, the folding sections $\mathbf{20}_3$ and $\mathbf{22}_3$ belonging to these two adjacent shells come into contact with one other so as to form two other sides, straddling the core 2.

In addition, the two other shells 30 and 32 form a second bulb shape 50 for the second hand. Once these two bulb shapes 40 and 50 are in place, a covering strip 60 is then applied in a conventional manner, partly illustrated in this FIG. 4.

Figure 5:
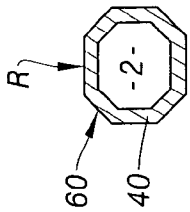
FIGS. 5, 6 and 7 are cross sectional views along the lines V-V, VI-VI and VII-VII as in FIG. 4.
Figure 6:
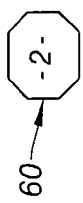
Figure 7:
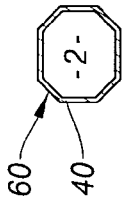

FIGS. 5 to 7 illustrate the cross section of three different areas of the racket handle thus obtained.

In FIG. 5 the cross section of this handle is at its maximum as it corresponds to the middle bulge of one of the bulb shapes, in this case that R of the bulb shape 40. FIG. 6 represents an area of minimum cross section of the racket, corresponding to the absence of a bulb shape. In other words, this area comprises only the core 2 to which the covering strip 60 is fitted. Finally, FIG. 7 corresponds to an area of the bulb shape for which the thickness thereof and, hence, the cross section of the handle have an intermediate value.

As has been seen above, the thickness of each shell decreases continuously from its middle bulge towards its two axial ends. The cross section of the racket handle therefore also decreases continuously from each bulge towards each of the ends.

The invention makes it possible to attain the previously mentioned objectives.

Specifically, the invention makes it possible to produce a racket having an ergonomic handle provided with at least one gripping bulb shape. In this respect, it should be underlined that the bulb shape 50 for the second hand is optional.

In addition, this ergonomic character may be obtained simply starting with a standard racket with a handle having a continuous cross section, which may, for example, be polygonal, oval or round. In this perspective, it suffices to remove the original covering strip, to locate the insert 10, then to refit this covering strip or to replace it with another. It will be noted that in the example described and shown the insert 10 is formed by the two shells 40 and 50. However, it is conceivable for this insert to be formed by a single one of these shells, whether in the case of a tennis racket or of a racket for another sport such as badminton or squash.

In addition, it can be noted that the shells designed to form the insert may be fitted axially at the desired location on the core of the handle. These shells may also be removed, then optionally moved, so as to ensure the best feelings for the player.

Figure 8:
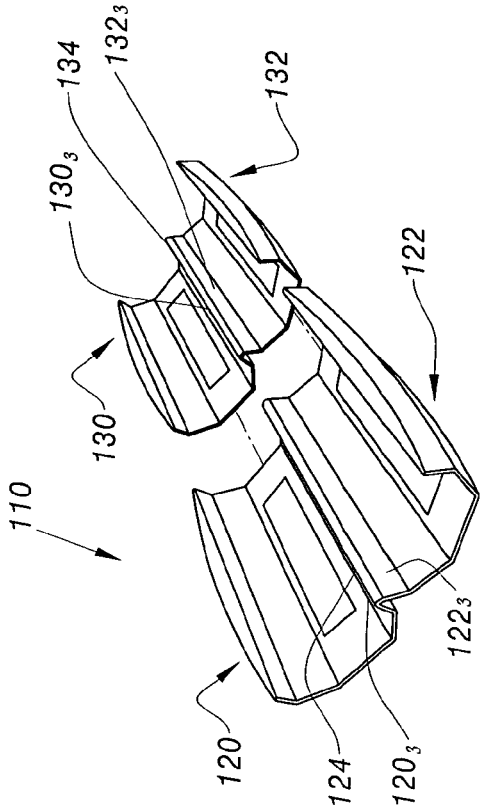
FIG. 8 is a perspective view, similar to FIG. 2, illustrating a variant embodiment of an insert according to the invention.

FIG. 8 illustrates a first variant embodiment of the invention. In this figure, the mechanical elements similar to those in the previous figures are here allocated the same numbers, increased by 100.

The difference between the insert 110 of this FIG. 8 and that 10 of the previous figures lies in the fact that each pair of shells 120, 122 and 130, 132 respectively is connected by a corresponding hinge 124, 134. Each hinge, which is for example formed by molding, extends on either side of a corresponding middle bulge. It enables the facing folding sections, $\mathbf{120}_3$, $\mathbf{122}_3$ and $\mathbf{130}_3$, $\mathbf{132}_3$ respectively belonging to two adjacent shells to be connected, which ensures that they are joined.

It is possible to connect two adjacent shells designed to form a single bulb shape using connecting means different from a hinge. Thus, it is conceivable to connect these two adjacent shells by means of compressible lateral tabs. This makes it possible in addition to adapt the shells to various types of handle, given that the presence of these compressible tabs makes it possible to make up for the differences in cross section.

By way of an additional variant (not shown), shells designed to form different bulb shapes are capable of being connected to one another. In this perspective, divisible axial bridges are conceivable, marked by the dot-and-dash line in FIG. 8. This can make the various shells unlosable before being fitted, then, after dividing the bridges, allow these shells to be located independently at suitable locations on the handle core.

Figure 9:
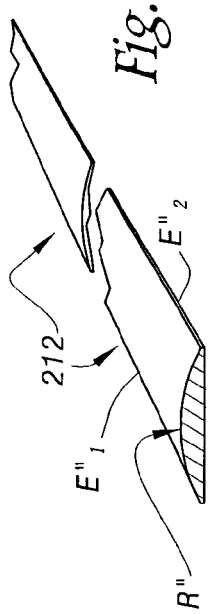
FIG. 9 is a perspective view illustrating a strip in which an insert according to another variant of the invention is capable of being cut.
Figure 10:
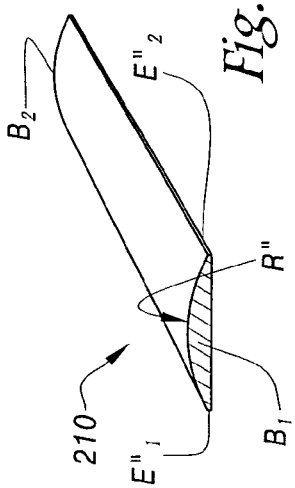
FIG. 10 is a perspective view illustrating the insert cut in the strip of FIG. 9.
Figure 11:
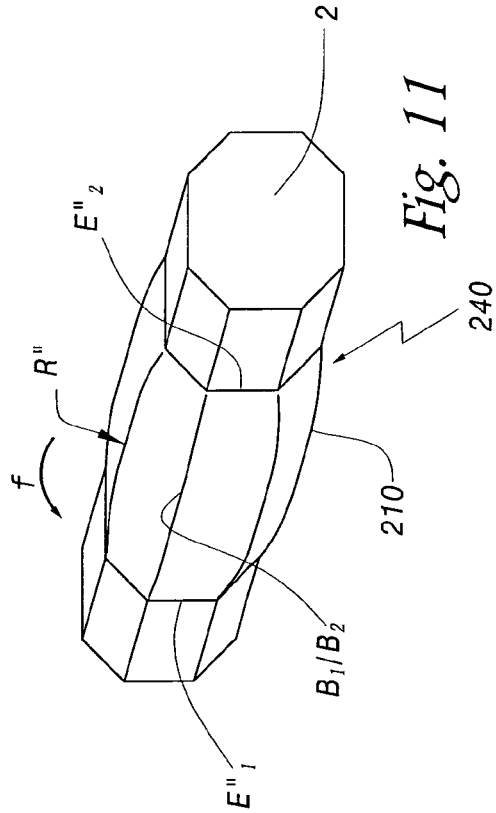
FIG. 11 is a perspective view illustrating the fitting of the insert of FIG. 10 around a racket handle.

FIGS. 9 to 11 illustrate another variant embodiment of the invention. In these figures, mechanical elements similar to those in FIGS. 1 to 7 are here allocated the same reference numbers, increased by 200.

The insert 210 of this embodiment is capable of being cut from a large strip 212 which is made of a flexible material, for example of an elastomer such as polyurethane. It is also possible to form this strip 212 from several materials. In this case, this strip has a core and a perimeter, the respective materials of which may be chosen depending on an appropriate aim, especially with a view to providing an anti-vibration effect.

Viewed from the side, the profile of this strip is identical to the longitudinal profile of the shell 20, as illustrated in FIG. 3. This strip 212 thus defines a bulb shape comprising a bulge R", along with two ends $E''_1$ and $E''_2$ of lesser thickness.

Depending on the value of the perimeter made by a given handle core, the strip 212 is cut to the appropriate dimensions, so as to form the insert 210, illustrated in FIG. 10. This insert is then wound around the core 2, according to the arrow f in FIG. 11, so that its two edges B1 and B2 are adjoining. A first bulb shape 240 is therefore formed, it being understood that it suffices to cut off another portion of the strip 210 in order to produce another bulb shape.

In these conditions the racket is provided with two inserts, each of which defines a corresponding bulb shape. Each insert may advantageously be relocated in a removable manner around the core 2. In particular, the inside face of the insert, namely that designed to be in contact with the core, may be coated with a "repositionable" adhesive.

This latter measure is advantageous. This is because a user is able to put each insert at a given location, then optionally to move it, depending on his own feelings. It will be noted that the fixing of the insert onto the core, which is first ensured by the adhesive means, is completed by the presence of the covering strip 60.

According to another advantageous variant embodiment of the invention, it is possible to replace the initially fitted insert with another insert having a different profile, namely, for example, with a more or less pronounced bulb shape. This new insert may be positioned either at the same location as the initial insert or at a different location. This variant makes it possible for the racket to be adapted to the feelings of the player as the latter has the opportunity to vary the profile of the handle simply and quickly.

Figure 12:
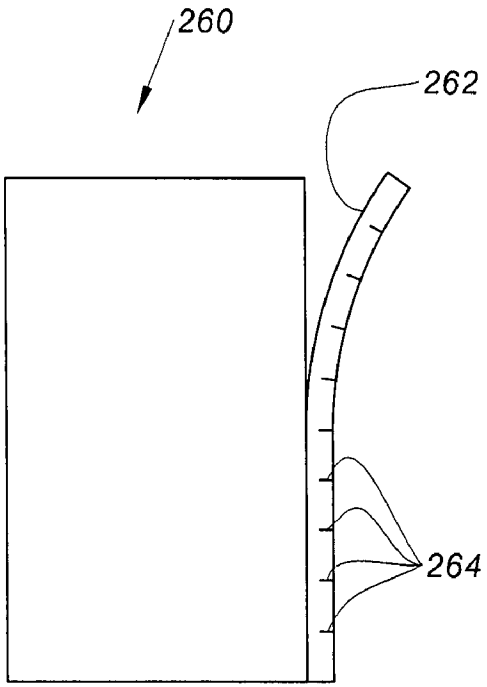
FIG. 12 is a side view illustrating packaging designed to accommodate the strip of FIG. 9.

FIG. 12 illustrates packaging 260 suitable for accommodating one or more strips such as that 212 described above. This packaging 260 is provided with a lateral end tape 262 which can be torn off so as to reach the interior volume of the packaging. Moreover, this tab 262 is provided with graduations 264 making it possible to cut the strip 212 to the appropriate length.

More precisely, the tape 262 is torn off, then it is wound around the handle that it is wished to equip with an insert according to the invention. Reading the corresponding graduation of the tape 262 makes it possible to deduce the perimeter of the handle and therefore to cut the strip 212 to the right length so as to isolate an insert 210 of suitable size.

Advantageously, the packaging 260 may contain several strips having different profiles. In other words, these strips define bulb shapes having different sizes and/or bulb shape profiles. This makes it possible for the player to fit inserts of variable profiles, depending on his feelings during play.

Figure 13:
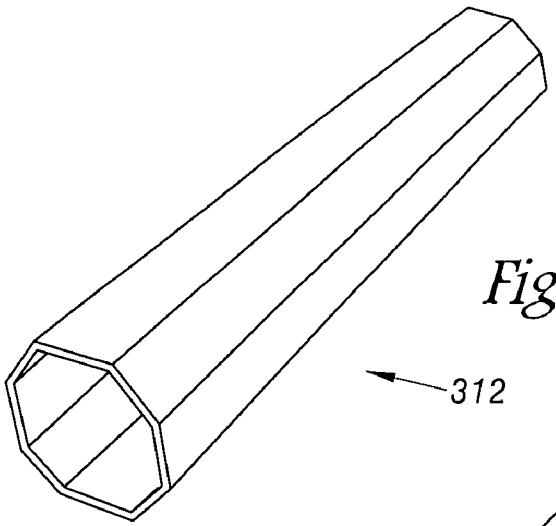
FIG. 13 is a perspective view illustrating a sleeve enabling the production of an insert according to an additional variant embodiment of the invention.
Figure 14:
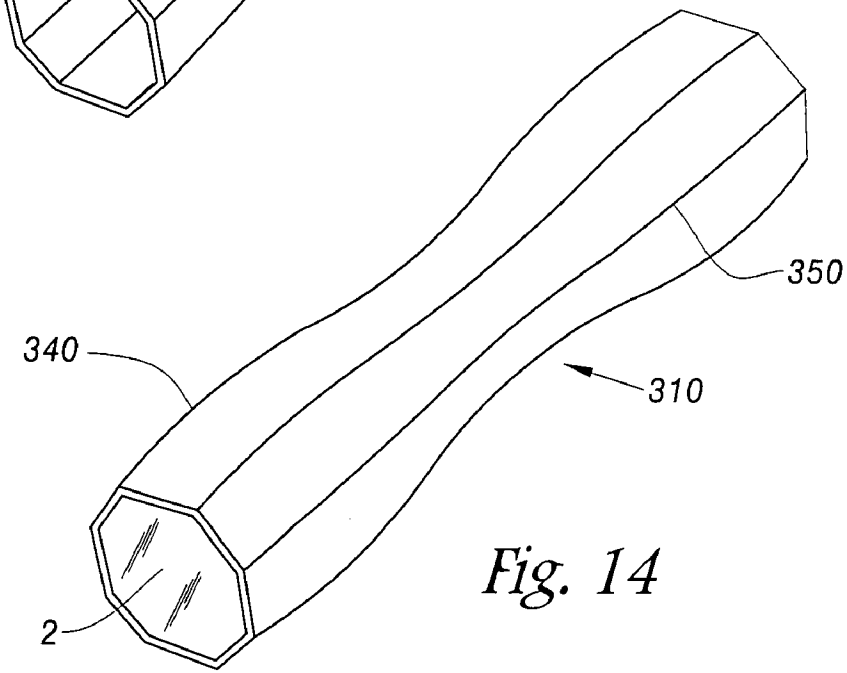
FIG. 14 is a perspective view illustrating the insert produced from the sleeve of FIG. 13 once fitted around a racket handle.

FIGS. 13 and 14 illustrate an additional variant embodiment of the invention. In these figures, the mechanical elements similar to those in the previous figures are here allocated the same reference numbers, increased by 300.

The insert 310 according to this embodiment is formed from a sleeve 312, which can be seen in FIG. 13, which is made of a thermoshrinkable material, such as polyethylene for example. This sleeve 312 has a size greater than that of the bulb shapes of the final insert 310. Furthermore, this sleeve 312 has an overall cylindrical outer form, i.e. its outer size is approximately constant, but it conversely has inner areas of greater thickness, not shown in FIG. 13, which are designed to form the final bulb shapes.

This sleeve 312 is then threaded onto the core 2, then subjected to a heating operation, for example at a temperature of 80 to 150° C. Given the nature of its constituent material, the initial areas of greater thickness of the sleeve make it possible to form final bulb shapes 340 and 350, with which the insert 310 illustrated in FIG. 14 is provided.

The invention claimed is:

1. A racket handle insert (10; 110; 210; 310) designed to be fitted around at least one part of the core (2) of this handle, this insert forming, once fitted around this core, at least one first bulb shape (40, 50; 240, 340; 350) which has a middle bulge (R; R'; R") with reference to a longitudinal axis of the handle, the transverse dimensions of each bulb shape decreasing continuously from this bulge in the direction of the two axial ends ($E_1$, $E_2$; $E'_1$, $E'_2$; $E''_1$, $E''_2$) of each bulb shape, the insert (10; 110) including a first pair of complementary shells (20, 22, 30, 32; 120, 122, 130, 132), each of which is suited to form a corresponding bulb shape (40, 50), these shells being made of a rigid material, the insert further including divisible connecting means between successive shells intended to form different bulb shapes.

2. The insert as claimed in claim 1, characterized in that, at least at its outer periphery, each bulb shape has an octagonal cross section at each point.

3. The insert as claimed in claim 1, characterized in that each shell comprises a middle partition ($\mathbf{20}_1$, $\mathbf{22}_1$), two intermediate flaps ($\mathbf{20}_2$, $\mathbf{22}_2$) and two folding end sections ($\mathbf{20}_3$, $\mathbf{22}_3$; $\mathbf{120}_3$, $\mathbf{122}_3$).

4. The insert as claimed in claim 1, characterized in that it is provided with means (124; 134) for connecting together two complementary shells (120, 122, 130, 132) intended to form a single bulb shape.

5. The insert as claimed in claim 4, characterized in that the connecting means comprise a hinge (124, 134) connecting these two shells (120, 122; 130, 132).

6. The insert as claimed in claim 4, characterized in that the connecting means comprise at least one compressible tab, making it possible to adapt these two shells to different cross sections of handle core.

7. The insert as claimed in claim 1, characterized in that the insert (210) is made of a flexible material.

8. The insert as claimed in claim 7, characterized in that this insert (210) is cut from a strip (212) of larger size.

9. The insert as claimed in claim 7, characterized in that the insert (210) is provided with a means for fixing removably onto the handle core.

10. The insert as claimed in claim 9, characterized in that the inside face of the insert is coated with an adhesive means of the repositionable type.

11. The insert as claimed in claim 7, characterized in that the flexible material is an elastomer.

12. A method for fitting at least one insert as claimed in claim 7, the method comprising cutting at least one strip (212) so as to isolate at least one insert (210) of suitable length, said strip being made of a flexible material and including at least a first bulb shape having a middle bulge (R"), the transverse dimensions of each bulb shape decreasing continuously from this bulge in the direction of the two ends ($E''_1$, $E''_2$) of each bulb shape, and fitting each insert around the racket handle.

13. The method as claimed in claim 12, in which, having fitted the insert around the racket handle, this insert is removed and repositioned at a different location on the handle.

14. The method as claimed in claim 12, in which, having fitted this insert, this insert is removed and another insert is fitted around the racket handle at the same location or at a different location on the racket handle.

15. The insert as claimed in claim 1, characterized in that the insert (310) is made of a thermoshrinkable material.

16. The insert as claimed in claim 15, characterized in that the insert (310) is made from a larger sleeve (312) made of a thermoshrinkable material.

17. A sleeve (312) made of a thermoshrinkable material, suited to form an insert (312) as claimed in claim 15 after having been subjected to a heating operation.

18. The insert as claimed in claim 15, characterized in that the thermoshrinkable material is polyethylene.

19. The insert as claimed in claim 1, characterized in that a first bulb shape (40; 240), intended to be put on the side of the main grip, has a length (L) between 50 and 130 mm, and a thickness e between 1 and 7 mm.

20. The insert as claimed in claim 19, characterized in that the length (L) of the first bulb shape (40; 240) is between 60 and 120 mm, and the thickness e of the first bulb shape (40; 240) is between 1.5 and 6 mm.

21. The insert as claimed in claim 1, characterized in that another bulb shape (50), intended to be put on the side of the second hand of the player, has a length (L') between 50 and 120 mm, and a thickness e' between 1 and 7 mm.

22. The insert as claimed in claim 21, characterized in that the length (L') of the other bulb shape (50) is between 60 and 100 mm, and the thickness e' of the other bulb shape (50) is between 1.5 and 6 mm.

23. A racket handle comprising a core (2), at least one insert (10; 110; 210; 310) fitted around this core (2), this insert being in accordance with claim 1, and a covering strip (60) fitted around the core (2) of this insert.

24. The handle as claimed in claim 23, wherein each insert is made of a flexible material and provided with a means for fixing removably onto the handle core so that each insert is fixed in a removable manner around the core (2).

25. A racket comprising a handle as claimed in claim 23.

26. The insert as claimed in claim 1, characterized in that the rigid material of the shells (20, 22, 30, 32; 120, 122, 130, 132) is polyamide.

27. A strip (212) made of a flexible material, able to be cut so as to produce an insert (210) as claimed in claim 7, this strip comprising at least a first bulb shape having a middle bulge (R"), the transverse dimensions of each bulb shape decreasing continuously from this bulge in the direction of the two ends ($E''_1$, $E''_2$) of each bulb shape.

28. Packaging (260) suitable to accommodate at least one strip (212) as claimed in claim 27, this packaging comprising a tape (262) which can be torn off, provided with graduations (264) with a view to measuring the perimeter of the handle before receiving a piece of this strip.

29. A set of strips as claimed in claim 27, comprising several strips having profiles different from one another.

* * * * *